US005398391A

United States Patent [19]

Yokochi

[11] Patent Number: 5,398,391

[45] Date of Patent: Mar. 21, 1995

[54] WIRE CONNECTION MEMBER FOR STRUNG BEADS ORNAMENTS

[76] Inventor: Tokio Yokochi, 1507, Inokoishi 2-chome, Meitoh-ku, Nagoya-shi, Aichi 465, Japan

[21] Appl. No.: 196,253

[22] PCT Filed: Jul. 31, 1992

[86] PCT No.: PCT/JP90/00969

§ 371 Date: Feb. 15, 1994

§ 102(e) Date: Feb. 15, 1994

[87] PCT Pub. No.: WO94/03084

PCT Pub. Date: Feb. 17, 1994

[51] Int. Cl.[6] ..... A44B 21/00; A44C 25/00

[52] U.S. Cl. ..... 24/616; 24/116 A; 24/682

[58] Field of Search ..... 24/682, 683, 615, 116 A, 24/135 N, 3 A, 3 C, 588

[56] References Cited

U.S. PATENT DOCUMENTS

| | | | |
|---|---|---|---|
| 1,057,484 | 4/1913 | Huber | 24/135 N |
| 1,435,829 | 11/1922 | Fischer | 24/616 |
| 1,771,125 | 7/1930 | Kahle | 24/116 A |
| 4,907,322 | 3/1990 | Kanno | 24/616 |

FOREIGN PATENT DOCUMENTS

| | | |
|---|---|---|
| 62-39510 | 3/1987 | Japan . |
| 62-141323 | 9/1987 | Japan . |
| 62-298305 | 12/1987 | Japan . |
| 3-39047 | 8/1991 | Japan . |

*Primary Examiner*—Victor N. Sakran

*Attorney, Agent, or Firm*—Spencer, Frank & Schneider

[57] ABSTRACT

There is provided a wire connecting member for strung beads ornaments which member is to fix a wire stringing ornaments to a clasp of the beads ornaments strung by a wire. The connecting member is compact, makes the procedure for fixing wire easy, and is reusable. Fixing the wire is made by way of passing the wire through the pathway holes by the clasp followed by inserting a pin into an insert hole. The wire does not come off from the connecting member due to frictional force against the outer surface of the pin and the inner circumferential surface of the insert hole. The pin does not come off from the connector body since parts of the wire are inserted into the concave part. The wire may be removed by cutting a part of the wire and the wire side is removed followed by removal of the wire side.

7 Claims, 5 Drawing Sheets

WIRE CONNECTION MEMBER FOR STRUNG BEADS ORNAMENTS

TECHNICAL FIELD

The present invention relates to technology for so-called "strung beads" personal ornaments (for example, necklace, bracelet and the like) which have strung beads of jewels such as pearls, corals and amber and their imitation. More specifically, the present invention relates to a connection member that connects the end of a wire to the clasp of ornaments in case that a wire is used to string the ornament beads.

TECHNOLOGY REVIEW

Conventionally, strung ornaments have been prepared by stringing with a thread made of synthetic fiber or natural fiber, pierced through the elements.

However, conventional threads are weak against "elongation" and "cutting".

Therefore, a metal wire such as stainless steel wire (including the one coated with nylon) has attracted attention for stringing the ornament elements.

However, when a wire is used, connection by binding to the clasp which is provided on the strung beads ornaments is not feasible as in a conventionally case made with a thread. That is, when a wire is connected as if by, binding, the wire is broken caused by work hardening. Alternatively, binding with a large curvature in order to avoid breakage results in knot too large making the appearance deteriorated. The clasp is to connect both ends of the ornament elements making the ornaments a loop.

Therefore,conventional connection members used for connecting the wire end to the clasp were as follows.

As shown in FIG. 5, a first connecting member 1 consists of a connector body 2 and a setscrew 5. The connector body 2 has a screw hole 3 corresponding to the setscrew 5 and a hole 4 being perpendicular to the screw hole 3 and allowing a wire W to pass through.

The wire W passes through the hole 4 of the connecting member 1 and forms a loop R that joins to a clasp 20 at the wire W terminal. The wire W is connected to the clasp 20 by fixing the wire end Wf of wire W screwing the setscrew 5 into the screw hole 3.

A second connecting member 8, as shown in FIG. 6, has only a hole 9 for passing the wire W through. The connecting member 8 connects to clasp 20, forming a loop R, by passing the wire W through the hole 9 of the connecting member 8. Thereafter, the connecting member 8 itself is crushed and deformed plastically to fix the end Wf of the wire W making the wire W connected to the clasp 20.

The first connecting member 1, however, requires consideration for the strength of the connector body 2 and the setscrew 5 itself as well as space for the screw thread in view of time necessity to provide a clasp. Thus, the shape of connecting member 1 becomes large loosing good appearance. In order to fix wire W, it has to be fixed by screwing the setscrew 5, which is time-consuming because of the small size of setscrew 5 itself.

The second connecting member 8 becomes plastically deformed in the course of fixing the wire W and cannot be reused. Therefore, preparation of the connecting member 8 from expensive gold or silver is often economically impossible.

The present invention resolves these problems and aims to provide a compact wire connecting member for strung beads ornaments. Another object of the present invention is to provide a wire connecting member that is easily fixed and applicable for strung beads ornaments.

Still another object of the present invention is to provide a wire connecting member for strung beads ornaments that can be reused.

SUMMARY OF THE INVENTION

The present invention provides a wire connecting member for strung beads ornaments, which member connects a wire stringing the beads ornaments to a clasp of the strung beads ornaments, having:

a pin having a concave part along the circumferential direction in the outer surface, said concave part being of a size that makes a part of the wire outer surface protruding from the pin outer surface when the wire is accommodated; and a connector body having an insert hole in which the pin can be inserted and three pathway holes that cross the insert hole rectangularity, one of said three pathway holes having a larger diameter that allows two wires to be inserted and passed through, and the other two of said three pathway holes having a smaller diameter respectively that allows one wire to be inserted and passed through and opening to roughly oppose the larger diameter hole on the inner surface of said insert hole.

In such a connecting member, the wire tip is passed successively through the larger pathway hole and one of the smaller pathway holes. Thereafter, the wire is passed through the clasp while making a loop. Then, the wire tip is passed through the other smaller pathway hole and the larger pathway hole in this sequence.

Afterwards, the pin is inserted into the insert hole of the connector body and pushed against the inner circumferential surface of the insert hole so as to separate two wire parts placed in the insert hole. And once at least one of the wire parts is placed in the concave part, the procedure to fix the wire end is completed.

When tension works under such fixed conditions, the wire part of the main part side (the side extending toward the clasp) of the two wire parts on the outer surface of the pin is to apply a pressure to the pin so that the wire part of the tip end part side (the side being folded back from the clasp) is pushed toward the inner circumferential surface of the insert hole.

Therefore, the frictional force of the wire parts against the pin outer surface and the insert hole inner surface prevents the wire from coming off whereby the wire is fixed to the connecting member and connected to the clasp. The pin does not come off from the connector body since the wire is accommodated in the concave part.

The wire connecting member according to the present invention does not use screw; therefore, the size of the connector body can be made small making it possible to reduce the size of the connecting member.

The wire connecting member according to the present invention can fix the wire to the connecting member simply by inserting the pin into the insert hole of the connector body after passing the wire through the predetermined holes making the fixing work of the wire easier. Since the two wire parts are placed in the insert hole separately through the two smaller diameter pathway holes, when inserting the pin, the pin is easily inserted between the two wire parts in the insert hole.

Moreover, in the wire connecting member according to the present invention, the main part side of the wire can be easily pulled out from connector body by cutting the wire part at the side being folded back from the clasp and removing the tip end side of the wire from the connector body: the pin can be removed from the connector body without deforming the pin or connector body making the reuse of the connecting member possible.

DETAILED DESCRIPTION OF THE INVENTION

Figure 2:
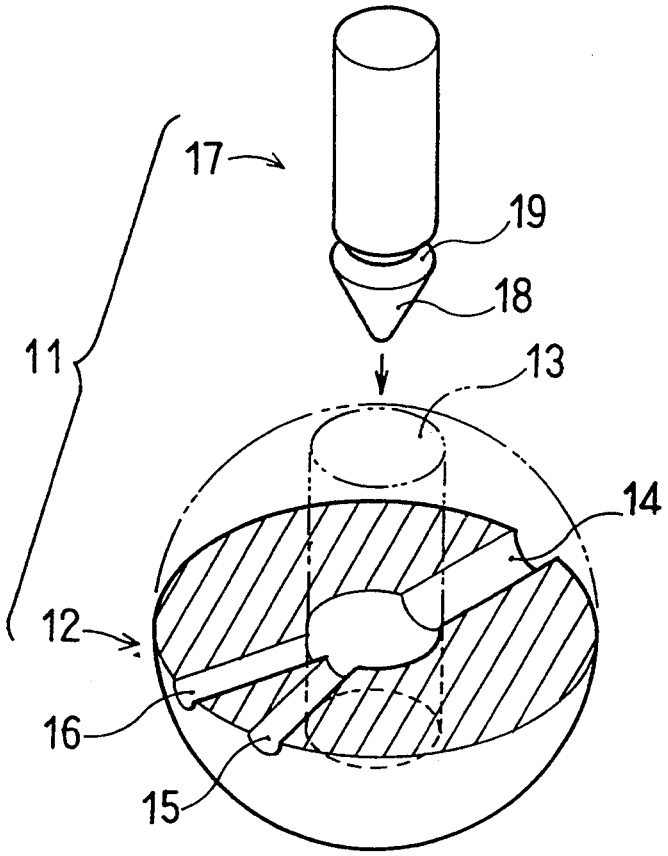
FIG. 2 is a fragmentary exploded perspective view of above embodiment.
Figure 3:
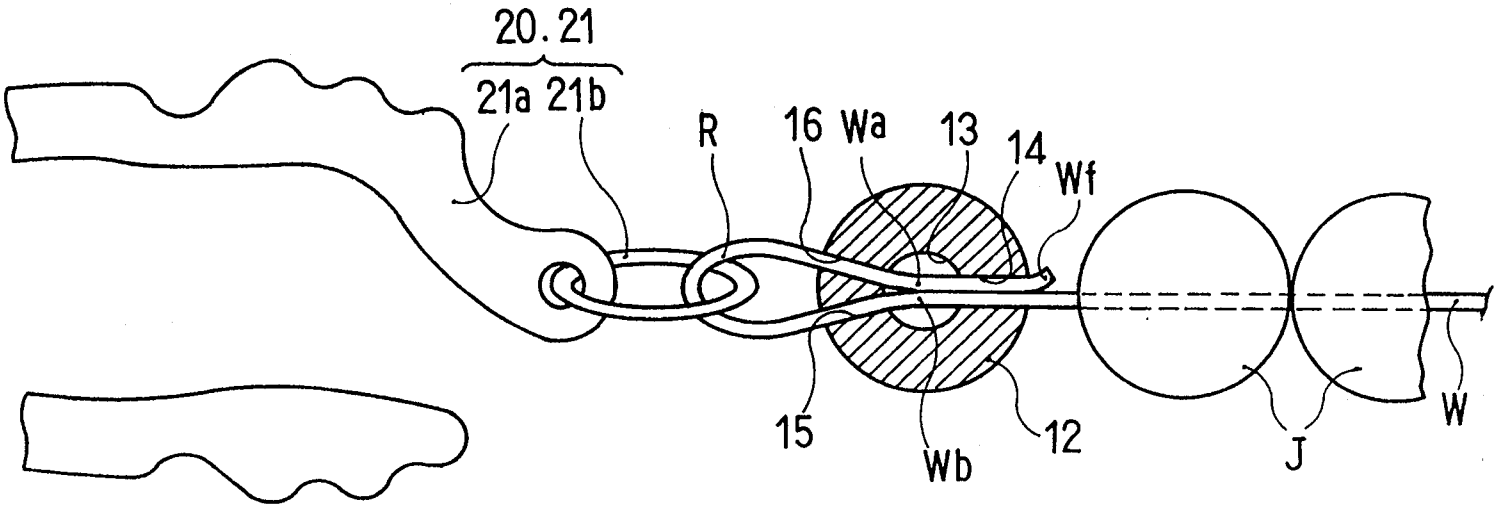
FIG. 3 is a plan view of above embodiment when a wire is passed trough.

The present invention will be described in detail in the following in connection with the accompanying drawings, In the embodiment shown in FIGS. 1 to 3, the wire connecting member 11 is made of silver and consists of connector body 12 and pin 17.

Pin 17 has at its lower end, a head part 18 of a cone shape with a sharpened tip. Just above the head part 18 of pin 17, a concave part 19 is formed surrounding the whole periphery. The depth of concave part 19 is sized to make the outer surface portion of wire W protrude from the outer surface of pin 19 when wire W is accommodated. In this embodiment, wire W is a nylon-coated stainless wire of 0.36 mm diameter inside concave part 19.

The connector body 12 has an insert hole 13 into which pin 17 can be inserted and three pathway holes 14, 15, and 16 respectively disposed perpendicular to pathway hole 13.

Pathway hole 14, which is one of the three pathway holes 14, 15, and 16, is the larger diameter pathway hole capable to accommodate two of wire W. The other two pathway holes 15 and 16, respectively of smaller diameter allowing one wire W to pass through, open in the inner circumferential surface of pathway hole 13 roughly opposed to pathway hole 14 of the larger diameter.

How connecting member 11 is used is now explained.

At first, the tip end Wf is passed through the larger pathway hole 14 from the outer surface of connector body 12 to the side of pathway hole 13, from where the tip end Wf is passed through one of the smaller diameter hole 15 to the outer surface of connector body 12. Then, the tip end Wf is led, while forming the loop R, through circular ring 21*b* attached to clasp body 21*a* of the male clasp 21 constituting the clasp 20. Thereafter, the tip end Wf is passed through the other smaller diameter hole 16 from the outer surface side of connector body 12 to the insert hole 13 side, from where the tip end Wf is passed through the larger diameter hole 14 to the outer surface side of connector body 12, resulting in the shape shown in FIG. 3.

Figure 1:
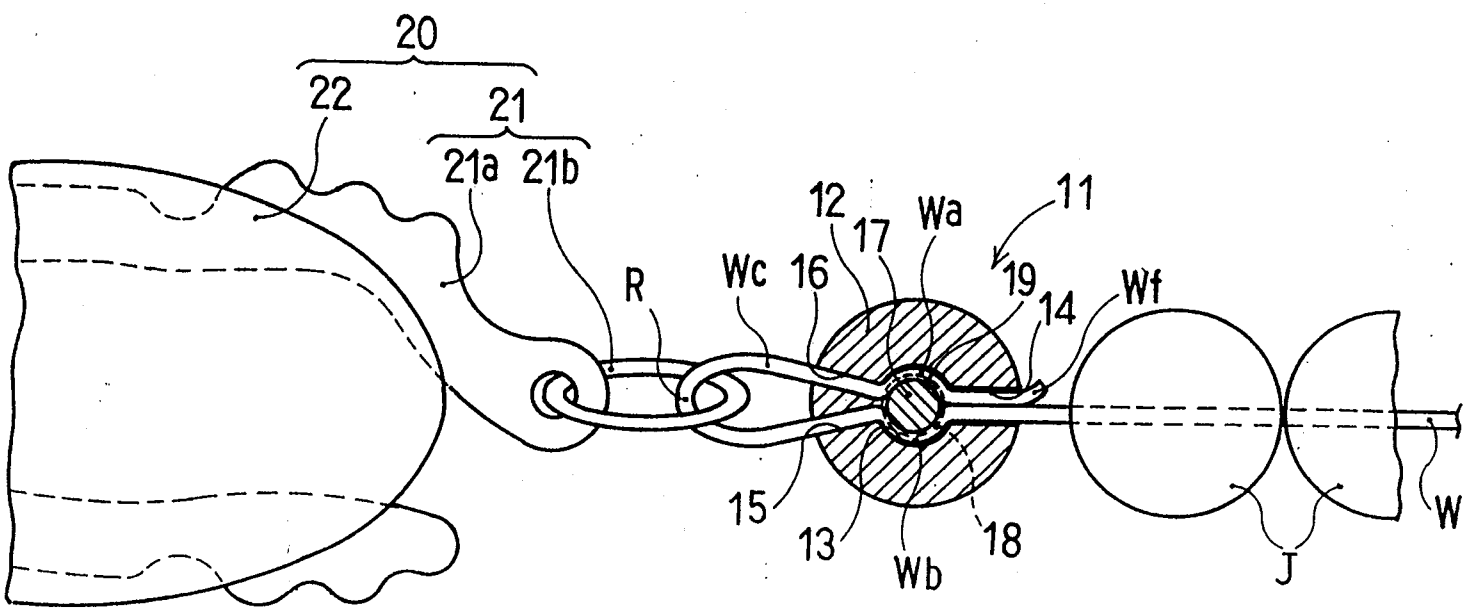
FIG. 1 is a cross sectioned view showing how a connecting member embodying the present invention is used.

The clasp 20 itself is,as shown in FIG. 1, publicly known and comprises male clasp 21 and female clasp 22; the ornaments J are made into a ring shape by inserting male clasp 21 into female clasp 22. Wire W is connected to male clasp 21 and female clasp 22 through connecting member 11.

Thereafter, pin 17 is inserted, from the head part 18, to the insert hole 13 of connector body 12 and pushed against the inner circumferential surface of insert hole 13 so as to separate the two wire parts Wa and Wb that are placed in insert hole 13. And after arranging the wire parts Wa and Wb into the concave part 19, the procedure to fix wire W is completed and wire W is connected to the male part 21 of the clasp 20 (see FIG. 1).

In these fixed conditions, when tension acts on wire W is, wire part Wb of the main part side (the side extending toward the clasp 20) of the two wire parts Wa and Wb tends to be straight and pushes wire part Wa of the tip end part side (the side being returned from the clasp 20) against the inner circumferential surface of insert hole 13; thus pressing pin 17.

In this way, wire W is prevented from coming off and fixed to connecting member 11 because of the frictional force caused by wire part Wb against the outer surface of pin 17 and the inner surface of insert hole 13. Pin 17 with wire W being accommodated in concave part 19 never come off from connector body 12.

Therefor, because wire connecting member 11 in this embodiment does not use a screw the size of connector body 12 can be made smaller and the wire connecting member can be made compact. Incidentally, connector body 12 of this embodiment was possible to be made in a small sphere of about 3 mm outer diameter.

The fixing procedure for wire W in the wire connecting member 11 of this embodiment is simple since wire W can be fixed to connecting member 11 by merely inserting pin 17 into insert hole 13 of connector body 12 after passing wire W through predetermined holes 14, 15, and 16.

The operation to insert pin 17 between the two wire parts Wa and Wb in insert hole 13 is easy since these two wire parts Wa and Wb are separately placed by means of the two smaller diameter pathway holes 15 and 16. In particular, the tip end of pin 17 is a cone in this embodiment, which makes the pin 13 insertion between the two wire parts Wa and Wb mush easier.

Moreover, if the wire part Wc at the side being folded back from the clasp 20 is cut and the tip end Wf side of wire W is removed from connector body 12 the main part side Wb of wire W can be easily pulled out from connector body 12, in the connecting member 11 of this embodiment. Also removal of wire W from connector body 12 makes it possible to dislodge easily pin 17 from insert hole 13. Thus, pin 17 can be removed from connector body 12 without deforming pin 17 and connector body 12; connecting member 11 is therefore reusable.

While wire W is passed through first from the smaller diameter pathway hole 15 at the preparation stage of this embodiment, the wire W may be passed through the smaller diameter pathway hole 16.

Figure 4:
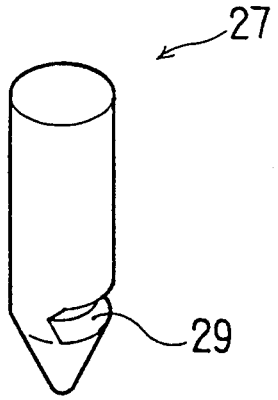
FIG. 4 is a perspective view showing another shape of the pin.
Figure 5:
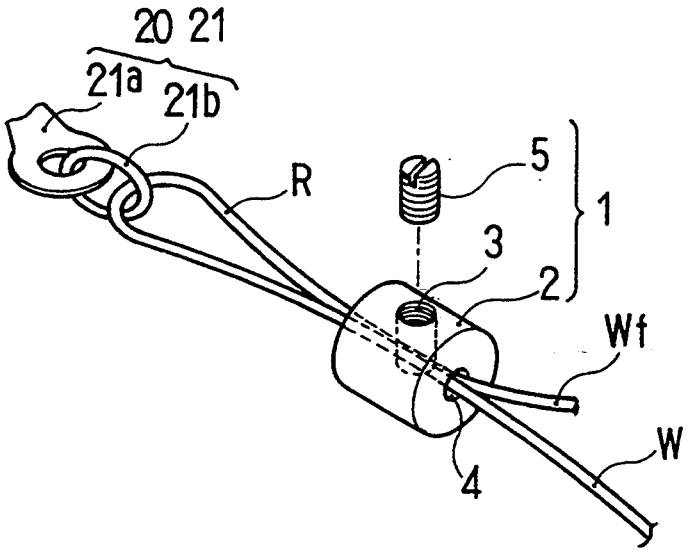
FIG. 5 is a fragmentary perspective view showing a conventional wire connecting member.
Figure 6:
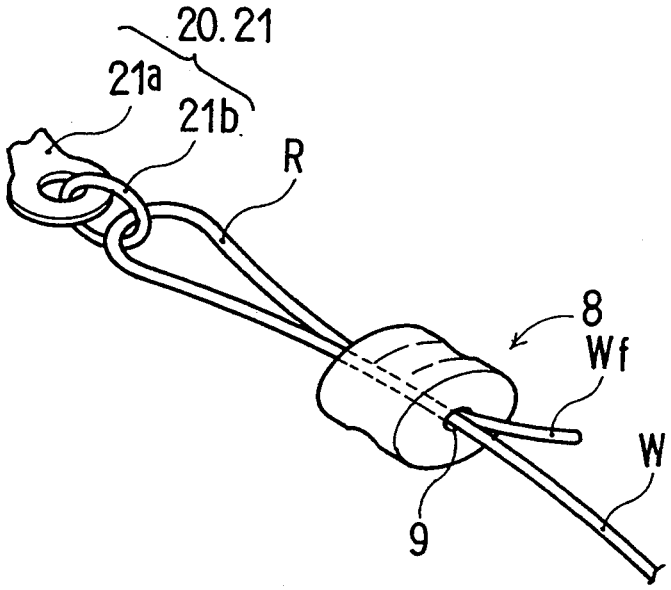
FIG. 6 is a perspective view showing another conventional wire connecting member.

While the concave part 19 is formed around the whole periphery of pin 17 in this embodiment, the object of installing concave part 19 is to prevent pin 17 from coming off when pin 17 is inserted into insert hole 13 and it is not necessary to provide the concave part 17 around the whole periphery. The concave part may be provided around a part of the periphery as shown by pin 27 in FIG. 4, So as to be fixed by either wire part Wa or Wire part Wb.

Furthermore, while connector body 12 is a sphere in this embodiment, the connector body may be of various shapes such as cylinder, square column, and others.

INDUSTRIAL APPLICABILITY

As explained heretofore, wire connecting members according to the present invention are useful for binding ornaments with a wire in strung beads ornaments such as necklaces.

I claim:

1. A wire connecting member for attaching a wire to a clasp, the wire having bead ornaments strung thereto, comprising:

a pin having a transversely arranged groove for accommodating the wire whereby a portion of an outer surface of the wire projects outward beyond the outer surface of said pin; and a connector body having an insert hole for receiving said pin, and first, second and third pathway holes extending from an exterior surface of said connector body into said insert hole, each said pathway hole being essentially perpendicular to said insert hole, said first and second pathway holes each having a diameter for accommodating one wire, said third pathway hole having a diameter for accommodating two wires, said first and second pathway holes being arranged so that their respective openings into said insert hole are oppositely located from said third pathway hole.

2. A wire connecting member as defined in claim 1, wherein said pin is cylindrically shaped.

3. A wire connecting member as defined in claim 2, wherein said cylindrically shaped pin has an conically-shaped end region for insertion into said insert hole.

4. A wire connecting member as defined in claim 2, wherein said groove extends around the circumference of said pin.

5. A wire connecting member as defined in claim 1, wherein said groove extends around a portion of the perimeter of said pin.

6. A wire connecting member as defined in claim 1, wherein said connector body comprises a sphere having an outer diameter of about 3 mm.

7. A wire connecting member as defined in claim 1, wherein said connector body has a shape corresponding to the bead ornaments.

* * * * *

UNITED STATES PATENT AND TRADEMARK OFFICE

CERTIFICATE OF CORRECTION

PATENT NO. : 5,398,391

DATED : March 21, 1995

INVENTOR(S) : Tokio YOKOCHI

It is certified that error appears in the above-indentified patent and that said Letters Patent is hereby corrected as shown below:

On the title page, Item [86], please correct to read

PCT No.: PCT/JP92/00969.

Signed and Sealed this

Sixth Day of June, 1995

Bruce Lehman

*Attest:*

BRUCE LEHMAN

*Attesting Officer*

*Commissioner of Patents and Trademarks*